US008740071B1

(12) United States Patent
Higgs et al.

(10) Patent No.: US 8,740,071 B1
(45) Date of Patent: Jun. 3, 2014

(54) METHOD AND APPARATUS FOR SHOCKWAVE ATTENUATION VIA CAVITATION

(75) Inventors: Christopher Higgs, Kirkland, WA (US); Brian J. Tillotson, Kent, WA (US)

(73) Assignee: The Boeing Company, Chicago, IL (US)

( * ) Notice: Subject to any disclaimer, the term of this patent is extended or adjusted under 35 U.S.C. 154(b) by 29 days.

(21) Appl. No.: 13/449,025

(22) Filed: Apr. 17, 2012

Related U.S. Application Data

(63) Continuation-in-part of application No. 13/302,614, filed on Nov. 22, 2011.

(51) Int. Cl.
*G06G 7/80* (2006.01)

(52) U.S. Cl.
USPC ..... 235/412; 235/400; 235/413

(58) Field of Classification Search
USPC ..... 235/400, 401, 412, 413
See application file for complete search history.

(56) References Cited

U.S. PATENT DOCUMENTS

| | | | | |
|---|---|---|---|---|
| 1,195,042 | A * | 8/1916 | Leon | 114/20.1 |
| 2,405,694 | A * | 8/1946 | Herzmark | 89/41.08 |
| 2,513,279 | A * | 7/1950 | Bradley | 89/1.11 |
| 3,050,707 | A * | 8/1962 | Baker et al. | 367/120 |
| 3,660,951 | A | 5/1972 | Cadwell | |
| 3,773,168 | A | 11/1973 | Meinass | |
| 3,875,844 | A * | 4/1975 | Hicks | 89/1.11 |
| 3,943,870 | A * | 3/1976 | Paslay | 114/20.1 |
| 4,215,630 | A * | 8/1980 | Hagelberg et al. | 89/1.11 |
| 4,313,181 | A * | 1/1982 | Holm | 367/1 |
| 4,543,872 | A | 10/1985 | Graham et al. | |
| H1231 | H * | 9/1993 | Richards | 356/5.03 |
| 5,341,718 | A * | 8/1994 | Woodall et al. | 89/1.11 |
| 5,394,786 | A | 3/1995 | Gettle et al. | |
| 5,400,688 | A * | 3/1995 | Eninger et al. | 89/1.11 |
| 5,739,458 | A | 4/1998 | Girard | |
| 6,029,558 | A | 2/2000 | Stevens et al. | |
| 6,256,263 | B1 * | 7/2001 | Stevens | 367/1 |
| 6,266,926 | B1 | 7/2001 | Figge et al. | |

(Continued)

FOREIGN PATENT DOCUMENTS

| | | |
|---|---|---|
| WO | 97/16697 | 5/1997 |
| WO | 2011/148165 | 12/2011 |

OTHER PUBLICATIONS

PCT, International Search Report and Written Opinion, International Application No. PCT/US2012/061017 (Jan. 18, 2013).
Office Action, U.S. Appl. No. 13/302,614 (Jan. 3, 2014).

*Primary Examiner* — Paultep Savusdiphol
(74) *Attorney, Agent, or Firm* — Clifford G. Cousins

(57) ABSTRACT

A method and system for attenuating a shockwave propagating through a first medium. The method and system may include providing a sensor for detecting a shockwave-producing event, which may include detecting an explosive device or detecting an explosion from an explosive device, determining a direction and distance of the shockwave relative to a defended target, calculating with a computer control a firing plan, and interposing a second medium between the shockwave and a protected asset if cost effective to do so. The second medium may be different from the first medium and the shockwave may be reflected, refracted and dispersed, or absorbed as it passes through the second medium prior to reaching the protected asset, and thus may be attenuated in force as it reaches the protected asset.

20 Claims, 6 Drawing Sheets

(56) References Cited

U.S. PATENT DOCUMENTS

| | | | | |
|---|---|---|---|---|
| 6,279,449 | B1 | 8/2001 | Ladika et al. | |
| 6,412,391 | B1 | 7/2002 | Stevens et al. | |
| 6,595,102 | B2 | 7/2003 | Stevens et al. | |
| 6,653,972 | B1 * | 11/2003 | Krikorian et al. | 342/62 |
| 6,782,790 | B2 * | 8/2004 | Barrett | 89/1.11 |
| 7,077,049 | B2 * | 7/2006 | Shumov et al. | 89/36.17 |
| 7,213,494 | B2 | 5/2007 | James | |
| 7,421,936 | B2 | 9/2008 | Barger et al. | |
| 7,437,987 | B1 | 10/2008 | Ohnstad et al. | |
| 7,827,900 | B2 | 11/2010 | Beach et al. | |
| 7,866,250 | B2 | 1/2011 | Farinella et al. | |
| 7,878,103 | B2 * | 2/2011 | Imholt et al. | 89/36.08 |
| 8,042,449 | B2 | 10/2011 | Farinella et al. | |
| 8,051,762 | B2 | 11/2011 | Beach et al. | |
| 8,141,470 | B1 | 3/2012 | Farinella et al. | |
| 8,151,710 | B2 * | 4/2012 | Fu et al. | 102/399 |
| 8,436,730 | B2 | 5/2013 | Fischbach et al. | |
| 8,437,223 | B2 | 5/2013 | Barger et al. | |
| 8,448,559 | B2 | 5/2013 | Hunn et al. | |
| 8,555,768 | B1 | 10/2013 | Barker et al. | |
| 2004/0107827 | A1 | 6/2004 | Edberg et al. | |
| 2007/0006723 | A1 | 1/2007 | Waddell, Jr. et al. | |
| 2007/0180983 | A1 | 8/2007 | Farinella et al. | |
| 2008/0190276 | A1 | 8/2008 | Barger et al. | |
| 2009/0114084 | A1 | 5/2009 | Thinn et al. | |
| 2009/0266226 | A1 | 10/2009 | Beach et al. | |
| 2010/0319524 | A1 | 12/2010 | Farinella et al. | |
| 2010/0319526 | A1 | 12/2010 | Imholt et al. | |
| 2011/0120294 | A1 | 5/2011 | Beach et al. | |
| 2011/0168004 | A1 | 7/2011 | Henegar | |
| 2011/0297031 | A1 * | 12/2011 | Fu et al. | 102/399 |
| 2012/0060677 | A1 | 3/2012 | Farinella | |

* cited by examiner

METHOD AND APPARATUS FOR SHOCKWAVE ATTENUATION VIA CAVITATION

FIELD

The disclosure relates to shockwave attenuation devices, and more particularly to a method and apparatus for interposing an intermediate medium to attenuate a shockwave.

BACKGROUND

Explosive devices are being used increasingly in asymmetric warfare to cause damage and destruction to equipment and loss of life. The majority of the damage caused by explosive devices results from shrapnel and shockwaves. Shrapnel is material, such as metal fragments, that is propelled rapidly away from the blast zone and may damage stationary structures, vehicles, or other targets. Damage from shrapnel may be prevented by, for example, physical barriers. Shockwaves are traveling discontinuities in pressure, temperature, density, and other physical qualities through a medium, such as the ambient atmosphere. Shockwave damage is more difficult to prevent because shockwaves can traverse an intermediate medium, including physical barriers.

Damage from shockwaves may be lessened or prevented by interposing an attenuating material between the shockwave source and the object to be protected. This attenuating material typically may be designed or selected to absorb the energy from the shockwave by utilizing a porous material that distorts as the energy of the shockwave that is absorbed.

U.S. Pat. No. 5,394,786 to Gettle et al. describes a shockwave attenuation device that utilizes an absorbing medium. That assembly includes porus screens that form an enclosure filled with a pressure wave attenuating medium. This attenuating medium may be an aqueous foam, gas emulsion, gel, or granular or other solid particles. However, as shown and described in the drawings of that patent, the shockwave attenuating assembly must be positioned before the explosion occurs and surround the area to be protected. For example, the assembly may be positioned on the side of a vehicle to prevent damage to the vehicle or passengers within.

A similar shockwave attenuation device is described in U.S. Patent Publication No. 2007-0006723 to Waddell, Jr. et al. That device includes a number of cells filled with an attenuating material, such as aqueous foams. However, like the device described in Gettle et al., the pressure-attenuating material and device must be positioned on a structure, surface, or person desired to be protected by the system before the explosion occurs.

One feature common among prior art shockwave attenuation systems is that they require an intermediate medium or structure that acts to attenuate the force of the shockwave by absorbing the energy of the shockwave. Although only a portion of the shockwave may pass through the medium, the energy of the shockwave is nevertheless significantly reduced by the intermediate medium. However, because these systems are structural, they must be fixed in place before a shockwave is created. Further, these shockwave attenuation systems may not protect an entire vehicle or person. For example, attenuating panels are not transparent and therefore cannot be placed over windows or used as facemasks in helmets. They also may be bulky and heavy, and therefore negatively impact the performance of a vehicle on which they are mounted.

Such prior art shockwave attenuation systems may not be effective to protect waterborne assets in which an incoming threat may be in the form of a torpedo, ballistic shell, bomb or a naval mine. Therefore, a need exists for a shockwave attenuation device that is capable of dynamically interposing a medium between an explosion source and a protected asset. There is also a need for an intermediate medium that effectively attenuates the energy from a shockwave and that allows for protection of a protected asset in a marine environment.

SUMMARY

According to one embodiment, a method for attenuating a shockwave propagating in a first medium may include either detecting an incoming threat or a shockwave-producing event, determining a direction of the shockwave from the threat or event relative to a protected asset, and interposing a second medium, different from the first medium, between the shockwave and the protected asset such that a shockwave produced by the event contacts the second medium and is attenuated in energy thereby prior to reaching the protected asset.

According to another embodiment, a system for attenuating a shockwave propagating in a first medium includes a sensor for detecting a source of the shockwave and generating a detection signal, a projectile launcher configured to launch projectiles in a pre-set quantity and direction into the first medium and thereby form the second medium, and a control configured to receive the detection signal and activate the projectile launcher to deliver at least one projectile to the first medium adjacent a protected asset. In one embodiment, the first medium may be a body of water contacting the protected asset, and the second medium may be a cavitation region formed by passage of the projectile through the first medium. In that embodiment, the protected asset may be surface ship, a barge, an offshore platform, or a submarine.

The control may direct the launcher to deliver the projectile at a location and in a manner that may create a transient cavitation region between the shockwave and the protected asset. The shockwave may contact the boundary between the body of water and the cavitation region and be at least partly reflected. The remaining portion of the shockwave may be partly refracted and dispersed, thereby diminishing the energy density of the shockwave. As the shockwave passes through the cavitation region, it may be at least partly absorbed by the gases in the cavitation region by viscous dissipation or by deformation of the cavitation region.

As the shockwave leaves the cavitation region, it may be reflected and refracted further as it passes through the curved boundary layer between the cavitation region and the denser body of water on the opposite side of the cavitation region. And finally, the shockwave may be reduced further by forward motion of the water due to momentum imparted by the projectile's recent passage.

According to one embodiment, the sensor may be configured to detect an incoming threat, such as a bomb, ballistic shell or torpedo. The system may include a sensor configured to detect the signature of the incoming threat, and a computer that may compare the signature to known signatures of a plurality of different threats, estimate the probability that the incoming threat is one of the known threats and then estimate the probability distribution function of explosion magnitudes and locations relative to the protected asset. Based on stored data or models about the asset's vulnerability to shockwaves of various magnitudes from various directions, together with data or models of what the launcher and projectiles can do to attenuate shockwaves in which positions and in what time interval, the computer may form a plan to counter the threat at minimum cost. The computer may then activate the control to execute a firing plan in which the projectile launcher may launch one or more projectiles to create the cavitation region. In one embodiment, the computer may determine that the potential for damage to the protected asset from the shockwave may not justify deployment of the projectile launcher at all.

According to yet another embodiment, the sensor may be configured to detect an explosion from a threat that has already occurred. The threat may be an incoming threat, such as a ballistic shell or torpedo, or a stationary threat such as a mine. The system may include a sensor configured to detect the signature of the explosion, and a computer that may compare the signature to known signatures of a plurality of different explosives, estimate the probability that the explosion is from one of the known explosives and then estimate the probability distribution function of explosion magnitudes and locations relative to the protected asset.

Based on the magnitude of the detected explosion, stored data about the yield versus signature of each threat, the measured position of the explosion, and the shape and orientation of the protected asset, the computer estimates a probability distribution function of explosion magnitudes and locations relative to the protected asset. Based on stored data or models about the asset's vulnerability to shockwaves of various magnitudes from various directions, together with data or models of what the launcher and projectiles can do to attenuate shockwaves in what positions and in what time interval, the computer may form a firing plan to counter the threat at minimum cost.

The computer may then activate the control to execute a firing plan in which the projectile launcher may launch one or more projectiles to create the cavitation region. In one embodiment, the computer may determine that the potential for damage to the protected asset from the shockwave may not justify deployment of the projectile launcher at all, or that the explosion is too distant from the protected asset to warrant deployment.

The features, functions, and advantages that have been discussed can be achieved independently in various embodiments or may be combined in yet other embodiments further details of which can be seen with reference to the following description and drawings.

DETAILED DESCRIPTION

The disclosed shockwave attenuation method and system may utilize an intermediate medium that may be dynamically deployed between an explosion and a defended object. The intermediate medium may attenuate the energy from a shockwave through several vectors, rather than simply absorbing the energy of the shockwave.

Figure 1:
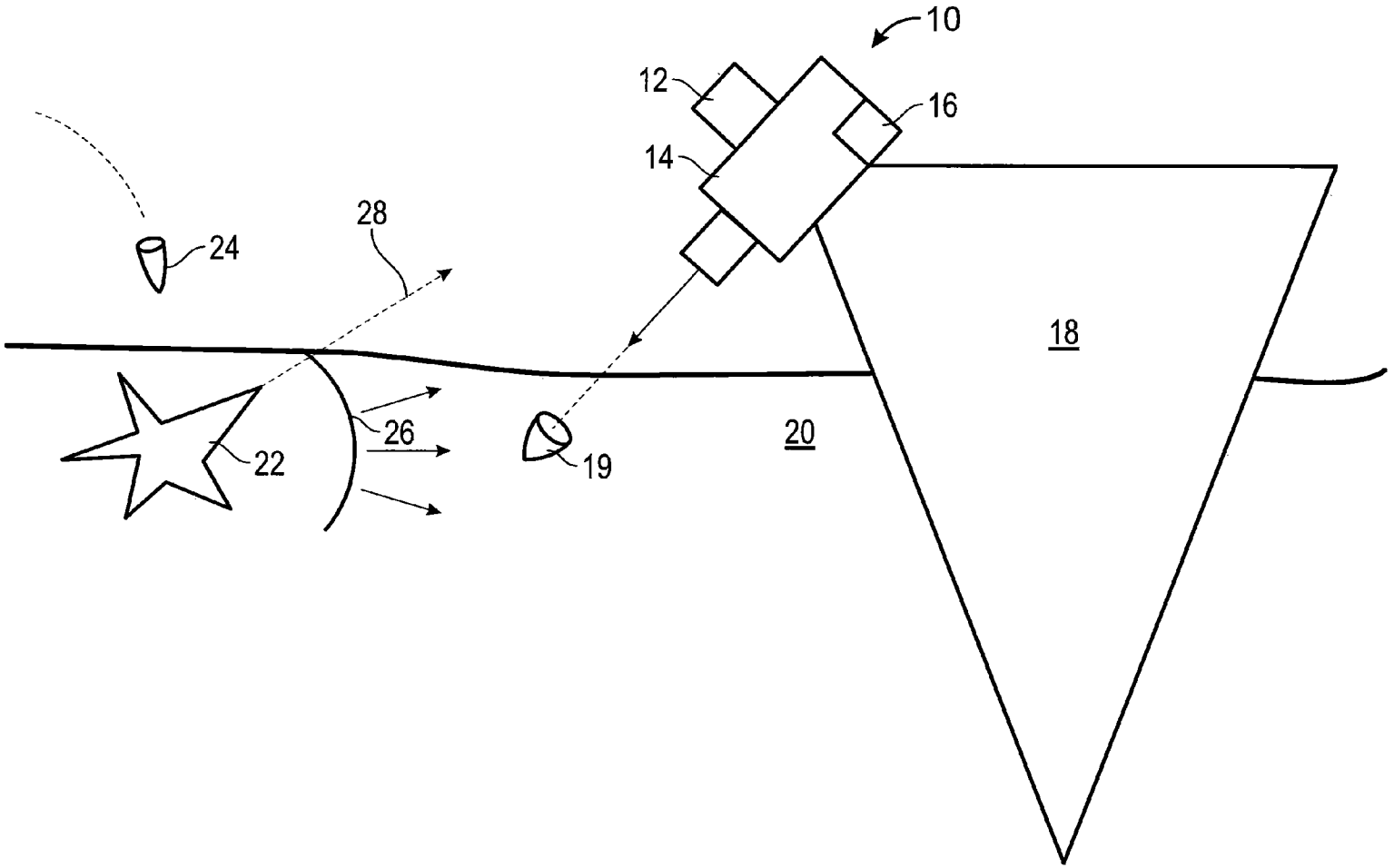
FIG. 1 is a schematic elevational view of one embodiment of the disclosed system for attenuating a shockwave via cavitation.

As shown in FIG. 1, in one embodiment, the system for attenuating a shockwave via cavitation, generally designated 10, may include a sensor 12, a projectile launcher 14 and a computer 16. The sensor 12 and computer 16 may be mounted on or incorporated in the projectile launcher 14, or they may be physically separate from the projectile launcher. The projectile launcher 14 may be mounted on a protected asset 18 that may be positioned on, over (e.g., a hovercraft or air-cushion vehicle), in, under or adjacent a body of water 20. The protected asset may be one or more of a surface ship, barge, offshore platform or submarine. In another embodiment, one or more components of the system 10 may be mounted on a beach, breakwater, pier or dock adjacent the body of water.

In one embodiment, the projectile launcher 14 may be mounted on a support, such as a surface ship, that is adjacent the protected asset 18. In another embodiment, the sensor 12 and computer 16 may be mounted on a surface ship or other platform that is separate from the protected asset 18.

Figure 2:
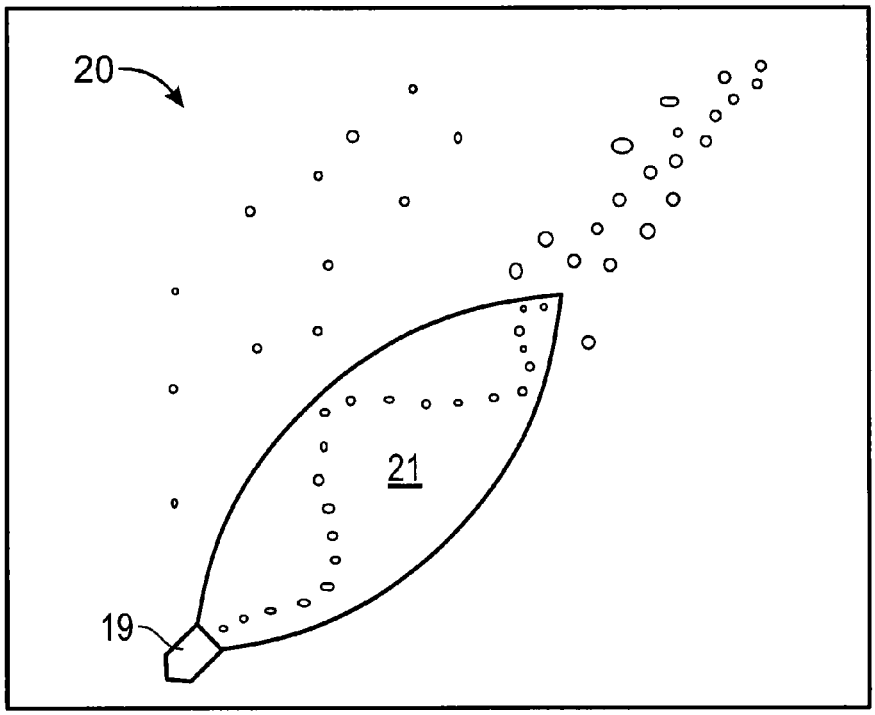
FIG. 2 is a detail showing a cavitation region created by a projectile used by the system of FIG. 1 as the projectile passes through a body of water.

The projectile launcher 14 may be mounted to fire a projectile 19 into the body of water 20 adjacent the protected asset 18. As shown in FIG. 2, when fired into the body of water 20 by the projectile launcher 14, the projectile 19 creates a cavitation region 21 as it travels through the body of water. The cavitation region 21 may be an area of low pressure immediately behind and trailing from the projectile 19 that may be filled with vapor and represents a second medium, different in temperature, density and composition from the body of water 20, the first medium. This cavitation region may last for less than a second then break up into discrete cavitation bubbles.

In one embodiment, the sensor 12 may be configured to provide measurements that enable the computer 16 to estimate the location and time of an explosion 22, either before or after it occurs, and direct the projectile launcher 14 to respond. In another embodiment, the sensor 12 may be configured to detect an incoming threat 24 containing an explosive device or devices, such as a ballistic shell, bomb, torpedo, depth charge, naval mine or bomb-laden surface vessel. In yet another embodiment, the sensor 12 may be configured to detect both the threat 24 and the explosion 22 from the threat. In one embodiment, two systems 10 may be deployed on a protected asset 18 in which one system is configured to detect an incoming threat 24 and the other system is configured to detect an explosion 22.

In an embodiment wherein the sensor 12 is configured to detect an incoming threat 24, the sensor may use known threat-detection technologies including radar, visible or infrared light, or passive or active acoustic sensors. The sensor 12 also may employ trajectory tracking and prediction methods.

In an embodiment wherein the sensor 12 is configured to detect an explosion 22 before the shockwave 26 from the explosion reaches the protected asset 18, the sensor 12 may be configured to detect a burst or pulse of electromagnetic radiation 28 that accompanies the explosion 22. The burst 28 travels at or near the speed of light and will reach the sensor 12 before the shockwave 26, which travels much slower, reaches the protected asset 18. This time lag between the pulse 28 and the shockwave 26 may be sufficient to allow the system to launch the projectile 19 into the body of water 20 to form a cavitation region 21 (FIG. 2) that intercepts the advancing shockwave.

The sensor 12 may be configured to detect any subset of the electromagnetic radiation 28 emitted during chemical detonations, including microwave bursts, flashes of infrared, visible and ultra-violet light, and x-ray bursts. In one embodiment, the sensor 12 is configured to detect electromagnetic radiation 28 at wavelengths in which water is substantially transparent, such as visible light, near ultraviolet or near infrared. In one embodiment, the sensor 12 may be configured to detect two different bands of electromagnetic radiation in order to minimize false positives and to enhance the accuracy of identifying the signature of the explosion 22.

The computer 16 is configured to receive measurements from the sensor 12, estimate a probability distribution of where and when an incoming threat 24 will detonate to form explosion 22 (or has already detonated), and directs the launcher to fire projectiles 19 with timing and direction that provide an optimal chance to minimize damage to the protected asset 18 from the shockwave 22. Even if the incoming threat 24 is, for example, a torpedo on a collision course with the protected asset 18, there is a chance that the torpedo misses, explodes in the water 20 near the protected asset, and thus provides an opportunity for the system 10 to deploy to attenuate the force of the shockwave 22 reaching the asset.

Figure 5:
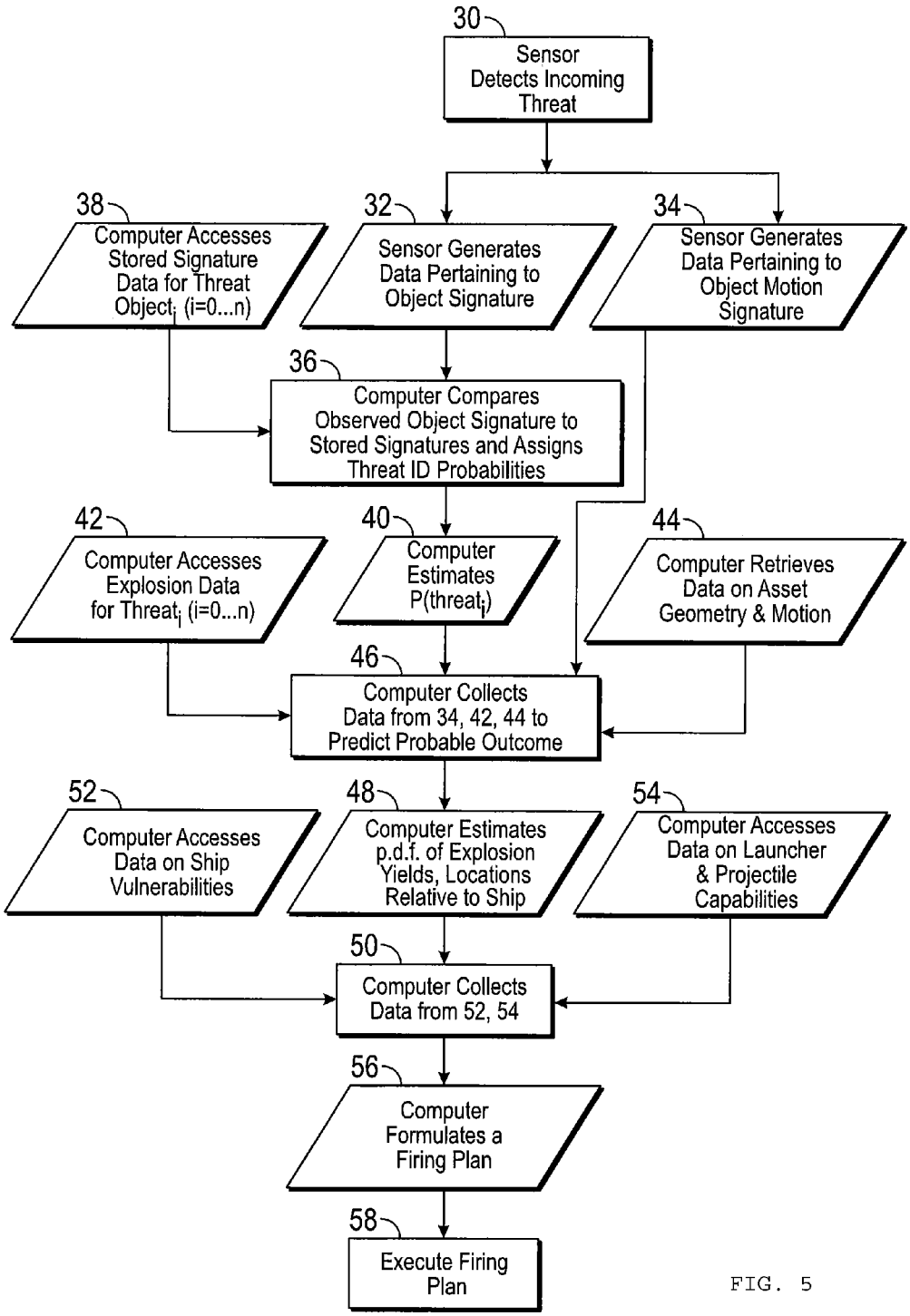
FIG. 5 is a flowchart of a process performed by the embodiment of FIG. 1 in which an incoming threat is detected.

As shown in the flow chart of FIG. 5, the computer 16 may be configured to develop a firing plan for the embodiment of the system 10 (FIG. 1) that includes a sensor 12 configured to detect an incoming threat 24 before it explodes. As shown in box 30, the process begins with the sensor 12 detecting the approach of an incoming threat 24. The sensor generates data pertaining to the signature of the threat, shown by box 32, and the motion of the threat, shown by box 34. Data pertaining to the signature of the threat 24 may include the shape of the threat and the heat signature of a propulsion system of the threat. Data pertaining to the motion of the incoming threat 24 may include trajectory, velocity, azimuthal angle relative to the launcher 14 and altitude.

As shown in box 36, the computer 16 receives the data from the sensor 12 relating to the signature of the threat 24 and accesses data on known threat object signatures, which may be stored in a database or accessible over a network as shown in box 38. The stored threat signatures may include various known threats, such as types of torpedoes. The computer compares the observed object signature with the retrieved signatures of known threat object signatures, as indicated in box 36. As shown in box 40, the computer 16 then estimates, for each stored known threat, how probable it is that the incoming threat 24 is that stored threat. As shown in box 46, the computer 16 takes or collects the stored data about the payload or warhead of each threat, shown in box 42, the motion of the threat, shown in box 34, and the shape, orientation and motion of the protected asset 18, shown in box 44. As shown in box 48, from this collected data, the computer 16 estimates a probability distribution function (p.d.f.) of explosion magnitudes and locations relative to the protected asset 18.

Next, as shown in box 50, the computer 16 may access stored data or models about the asset's vulnerability to shockwaves of various magnitudes from various directions, including crew injuries likely to result from shockwaves, as shown in box 52, and access stored data or models of what the launcher and projectiles can do to attenuate shockwaves in what positions and in what time intervals, as shown in box 54. As shown in box 56, with this information the computer 16 may formulate a firing plan to counter the explosion 22 by signaling the projectile launcher 14 to fire one or more projectiles 19 into a pre-determined intercept region between the advancing shockwave 26 and the protected asset 18. In one embodiment, the computer 16 is configured to develop a firing plan at minimum cost. Cost may include not only the cost to operate the launcher 14, but also the probable cost of damage to the asset 18 from the attenuated shockwave.

As shown in box 58, the computer 16 then may instruct the projectile launcher 14 to execute the firing plan. In some instances, the computer 16 may determine that the explosion yield is relatively small and/or the probable distance from the asset 18 is relatively large, so that the expected cost of operating the system 10 is greater than any damage that the asset may sustain. In such cases, the optimal or lowest-cost firing plan may be not to deploy the system 10 and fire the launcher 14.

Figure 6:
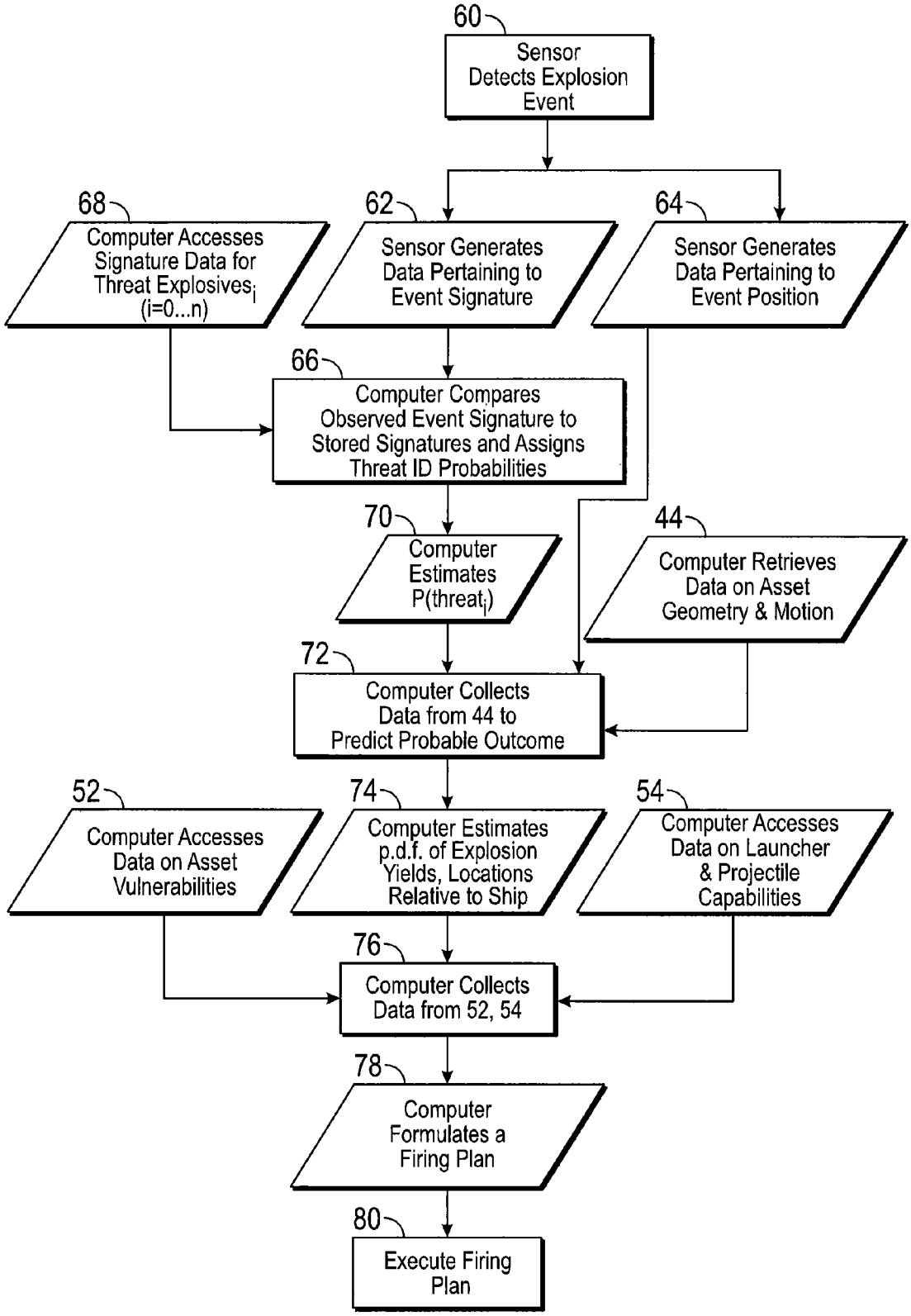
FIG. 6 is a flowchart of a process performed by the embodiment of FIG. 1 in which an explosion is detected.

As shown in FIG. 6, the computer 16 may be configured to develop a firing plan for the embodiment of the system 10 (FIG. 1) that includes a sensor 12 configured to detect an explosion 22 from an incoming threat 24 (i.e., an explosion that has already occurred). As shown in box 60, the process begins with the sensor 12 detecting the explosion 22 event. As shown in box 62, the sensor 12 generates data pertaining to the signature of the explosion, and the location of the explosion, as shown by box 64. Data pertaining to the location of the explosion 22 may include azimuthal angle relative to the launcher 14, altitude relative to the launcher (i.e., depth in the body of water 20) distance from the launcher, time of the explosion, and magnitude of the explosion.

As shown in box 66, the computer 16 may receive data from the sensor 12 relating to the signature of the explosion 22 and, as shown in box 68, access signature data on known explosives, which may be stored in a database or accessible over a network from a remote database. Such explosives may include C4 and ANFO (ammonium nitrate/fuel oil). The computer 16 may then compare the observed event signature data to the accessed signature data and, for each accessed signature, assign a probability that it matches the signature of the explosion.

As shown in box 70, the computer 16 then estimates, for each stored known explosion signature, how probable it is that the explosion 24 is from the explosive associated with that signature. As shown in box 72, the computer 16 takes or collects stored data about the position of the explosion (with associated uncertainty), shown in box 64, and the shape, orientation and motion of the protected asset 18, shown in box 44. As shown in box 74, from this data, the computer 16 estimates a p.d.f. of explosion magnitudes and locations relative to the protected asset 18.

Next, as shown in box 76, the computer 16 may access stored data or models about the vulnerability of the asset 18 to shockwaves of various magnitudes from various directions, including crew injuries likely to result from shockwaves, as shown in box 52, and access stored data or models of what the launcher and projectiles can do to attenuate shockwaves in what positions and in what time intervals, as shown in box 54. With this information, as shown in box 78, the computer 16 may formulate a firing plan to counter the explosion 22 by signaling the projectile launcher 14 to fire one or more projectiles 19 into a pre-determined intercept region between the advancing shockwave 26 and the protected asset 18. In one embodiment, the computer 16 may be configured to develop a firing plan at minimum cost. Cost may include not only the cost to operate the launcher 14, but also the probable cost of damage to the asset 18 from the attenuated shockwave.

As shown in box 80, the computer 16 then may instruct the projectile launcher 14 to execute the firing plan. In some instances, the computer 16 may determine that the explosion 22 is relatively small and/or the probable distance from the asset 18 is relatively large, so that the expected cost of operating the system 10 is greater than any damage that the asset may sustain. In such cases, the optimal or lowest-cost firing plan may be not to deploy the system 10 and fire the launcher 14.

Figure 3:
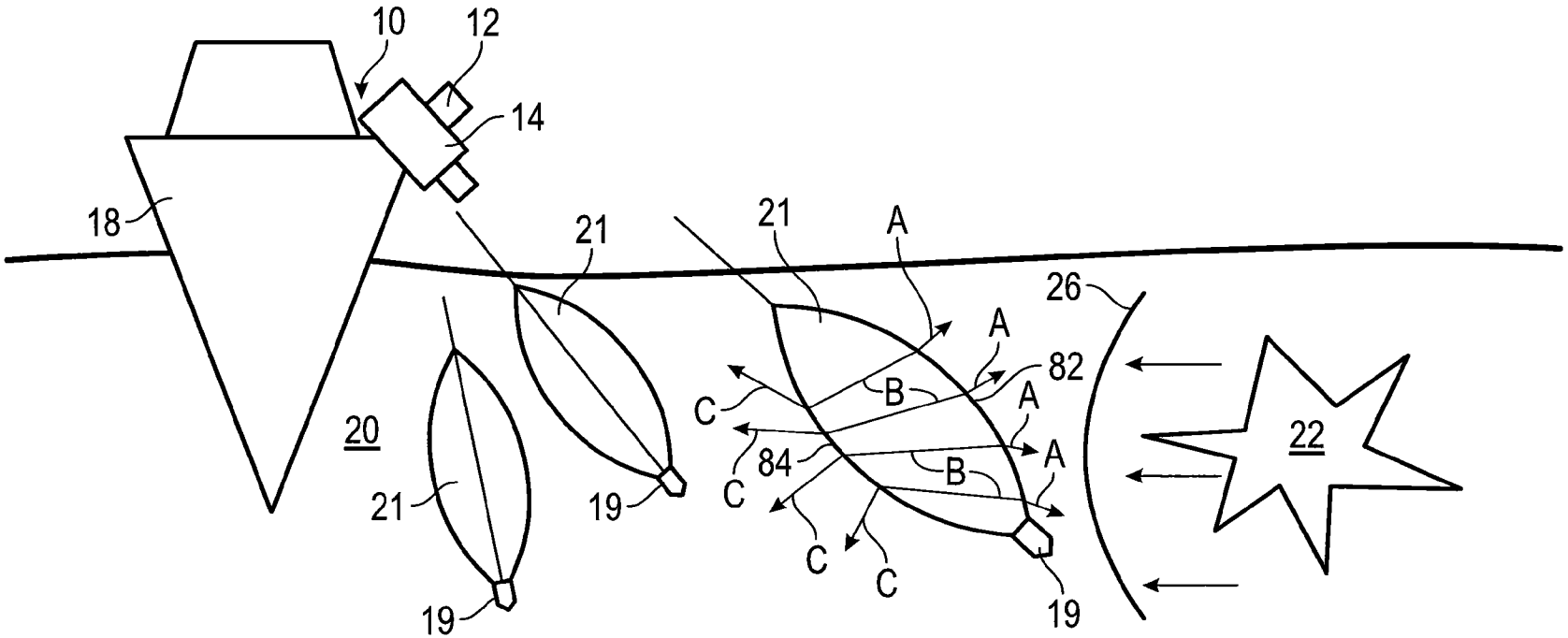
FIG. 3 is a schematic elevational view of the system of FIG. 1 showing attenuation of a shockwave as the shockwave contacts and passes through a cavitation region.
Figure 4:
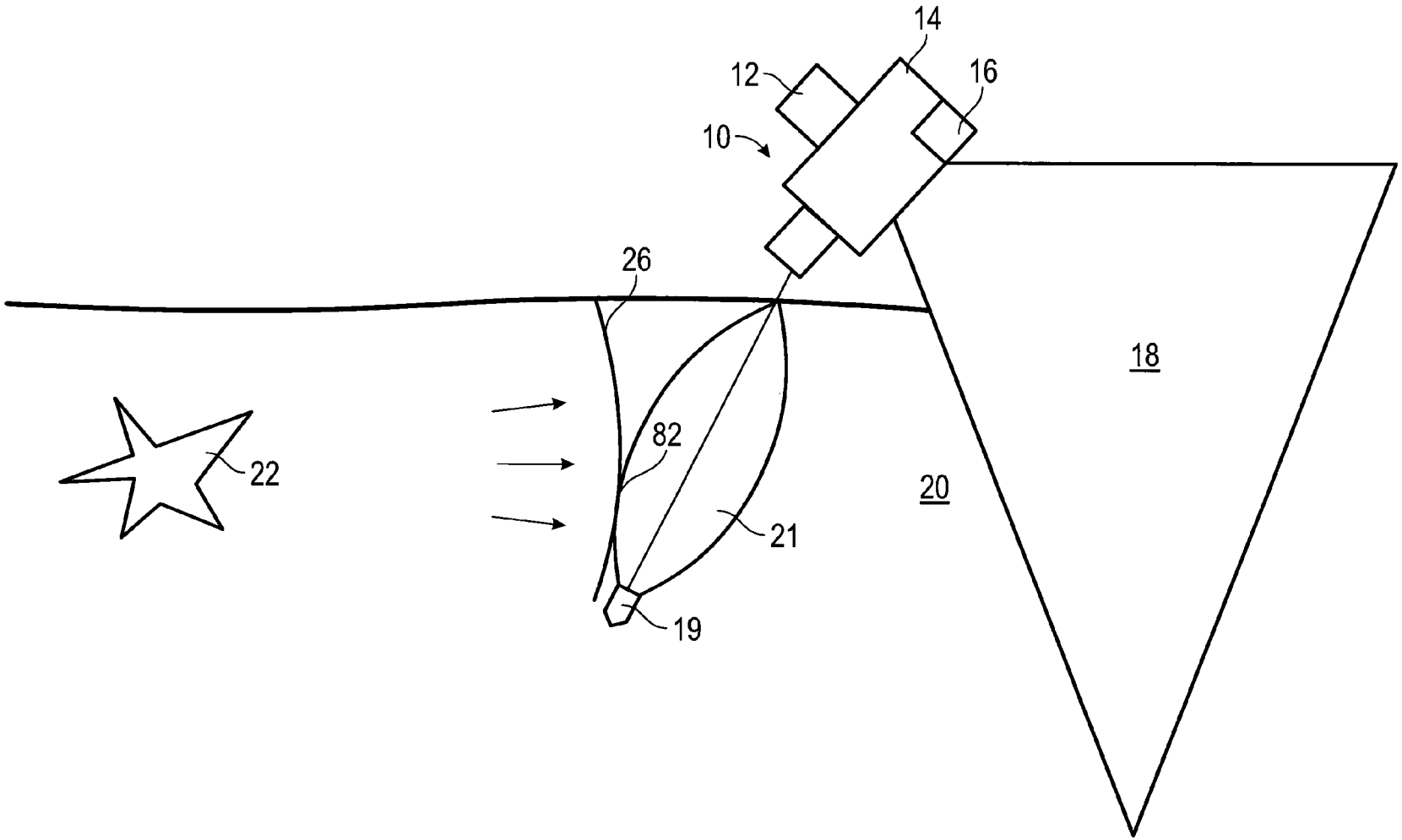
FIG. 4 is a schematic elevational view of the system of FIG. 1 in which a shockwave from an explosion contacts a cavitation region.

As shown in FIGS. 1, 3, and 4, when the system 10 is deployed, the launcher 14 may be actuated to propel projectiles 19 to a calculated, pre-set trajectory to an intercept region between the protected asset 18 and the oncoming shockwave 26 from an explosion 22 before the shockwave is too close to the protected asset 18 so that the cavitation region 21 created by the projectile(s) 19 may effectively attenuate the shockwave 26. In one embodiment, the launcher 14 may be a rapid-fire repeating gun that fires in response to a signal from the computer 16. Examples may include a machine gun, a chain gun or a rocket launcher. In such an embodiment, the launcher 14 may take the form of a single-barreled gun fixed in position to point in the general direction of the area covered by the sensor 12.

In another aspect, the launcher 14 may take the form of several gun-type barrels pointed in diverse directions, each loaded with projectiles. In this aspect, the computer 16 may select one or more, but not all, of the several barrels to fire, based upon the firing plan developed by the computer, which may take into account an azimuthal estimate from the computer. This aspect may provide a wider angle of coverage than a fixed, single-barrel embodiment.

In another aspect, the launcher 14 may take the form of a single gun-type barrel mounted on a high-speed mechanical pointing mechanism. The pointing mechanism may aim the barrel based on an azimuth estimate from the computer 16. This aspect may provide protection over a wider azimuth angle than the fixed single barrel embodiment, and my do so with less hardware than the multi-barrel embodiment. For applications where exceptionally fast response is needed, such as protection from close-in explosions, the launcher 14 may be gun in which a signal from the computer directly activates an igniter (or igniters) that fires the projectile (or projectiles). An example of such a gun is the FireStorm 40 mm multi-barrel grenade launcher manufactured by Metal Storm Limited of Darra, Australia. In yet another embodiment, the launcher 14 may take the form of a pre-existing projectile launcher, already mounted on a protected asset 18, such as a surface ship, that is capable of control and firing by the computer 16, may be employed. For example, the launcher 14 of the system 10 may take the form a Phalanx or other close-in weapons system, already present on most surface ships.

As shown in FIGS. 1, 3 and 4, the projectile 19 may be selected to induce a cavitation region 21 sufficiently fast, and with sufficient coverage to reduce the energy of the shockwave 26 before it reaches the protected asset 18. In combination with the launcher 14, the projectile 19 must be capable of being propelled through the body of water 20 at a speed and distance sufficient to create a cavitation region 21 sized and shaped to attenuate the shockwave 26 effectively. Depending upon the application, the projectile may be a regular bullet or shot, a sabot-mounted lightweight bullet to achieve high speed, a set of pellets or flechettes that spread out to give broader coverage, or a bullet that fragments upon impacting the body of water 20 (thereby creating a set of pellets that collectively may create more cavitation over a short distance than a single projectile or bullet).

The operation of one embodiment of the system 10 is shown in FIGS. 3 and 4. The sensor 12 detects an incoming threat 24 (see FIG. 1), and in another embodiment the sensor 12 detects an explosion 22 in a body of water 20. As described in detail with respect to FIGS. 4 and 5, the computer 16 calculates a firing plan, and if it is determined that it is cost-effective for the system 10 to be deployed, the computer 16 may send a command to the projectile launcher 14. If the launcher 14 is positionable, the computer 16 may provide co-ordinates including azimuthal angle and elevation to the launcher 14, or if the launcher 14 is a fixed, multi-barreled gun, the computer 16 may provide instructions on which of the barrels is to be fired.

Upon receipt of the signals from the computer 16, the launcher 14 may fire one or more projectiles 19 into the water 20 between the advancing shockwave 26 and the asset 18. As each projectile 19 passes through the water 20, it creates a cavitation region 21. The trajectory of each projectile 19 may be calculated to create a cavitation region 21 that is impacted by the shockwave 26. The leading portion 82 of the boundary layer between the cavitation region 21 and the water 20 may cause at least a portion of the shockwave 26 to be reflected generally away from the protected asset 18, as indicated by arrows A.

The leading portion 82 of the cavitation region 21 may be generally convex shaped, and also act as a lens, refracting and diffusing the shockwave 26 as it passes through the cavitation region, as indicated by arrows B. As the shockwave passes through the cavitation region 26, it may deform the bubble or cavity, which may absorb energy both as potential energy associated with deforming the bubble or cavity (i.e, distorting the bubble increases its surface area, and the concomitant increase in surface tension absorbs more energy). Also, deformation of the bubble or cavity causes it to oscillate, which absorbs kinetic energy from the shockwave.

As the shockwave 26 exits the cavitation region 21, the trailing interface 84 of the region may be curved and further refract the shockwave so its energy spreads over an even wider solid angle, as shown by arrows C. Another attenuation factor is the forward motion of the water 20 due to momentum imparted by the passage of the projectile 19. Such motion may further slow the shockwave, refracting it as well as reducing its intensity. Although a single projectile 19 and its associated cavitation region may not attenuate a shockwave 26 significantly, the collective effect of multiple projectiles, creating multiple cavitation regions 21 and bubbles, may have a significant effect.

While the methods and systems disclosed herein constitute preferred aspects of the disclosed shockwave attenuation apparatus and method, other methods and forms of apparatus may be employed without departing from the scope of the invention. Further, the disclosed methods and systems may be used alone, or in combination with other known defensive systems.

What is claimed is:

1. A shockwave attenuation system, comprising:

a sensor configured to generate a detection signal based on at least one of detecting an explosion capable of producing a shockwave and predicting an explosion from an explosive device that is capable of producing the shockwave;

a projectile launcher configured to launch projectiles in a pre-set quantity and direction; and a computer configured to receive the detection signal and activate the projectile launcher to deliver at least one projectile to a body of water adjacent a protected asset, the at least one projectile being delivered at a location and in a manner that creates a cavitation region between the shockwave and the protected asset such that the shockwave contacts the cavitation region and is attenuated in energy density before it reaches the protected asset.

2. The system of claim 1, wherein the protected asset is a waterborne asset.

3. The system of claim 1, wherein at least one of the sensor, the projectile launcher and the control is mounted on one of the protected asset, another waterborne asset, or adjacent the body of water.

4. The system of claim 1, wherein the shockwave is generated by the explosive device.

5. The system of claim 4, wherein the explosive device is one of a torpedo, a naval mine, a depth charge, a missile, a bomb, and a ballistic shell.

6. The system of claim 1, wherein the projectile launcher is configured to launch a projectile having a size, velocity and trajectory sufficient to form the cavitation region in the body of water to have a shape and position to at least one of at least partially reflect the shockwave, refract the shockwave, absorb energy from the shockwave, and slow the velocity of the shockwave toward the protected asset.

7. The system of claim 1, wherein the projectile launcher is one of a machine gun, a chain gun and a rocket launcher.

8. The system of claim 7, wherein the projectile launcher is configured to launch a plurality of projectiles to create a plurality of cavitation regions in the body of water adjacent the protected asset and in a path of the shockwave.

9. The system of claim 1, wherein the projectile launcher is configured to launch at least one of a regular bullet, shot, a sabot-mounted lightweight bullet, a set of pellets, a plurality of flechettes, and a bullet that fragments upon impacting the body of water.

10. The system of claim 1, wherein the sensor is configured to detect at least two bands of electromagnetic radiation generated by the explosion.

11. The system of claim 1, wherein the sensor is configured to detect at least one of the shape, trajectory and speed of an incoming threat containing the explosive device to calculate a signature of the incoming threat.

12. The system of claim 11, wherein the sensor is further configured to detect at least one of a location of the explosion, a time of the explosion, and a magnitude of the explosion.

13. The system of claim 12, wherein sensor detection is used to calculate an intercept region, the at least one projectile being launched by said projectile launcher to create the cavitation region.

14. The apparatus of claim 13, wherein the protected asset is one of a surface vessel, a submarine, and an offshore platform, and wherein the intercept region is determined based on one or more vulnerabilities of the protected asset.

15. A method of attenuating a shockwave, the method comprising:

detecting with a sensor at least one of an explosive device and an explosion from the explosive device; and launching with a projectile launcher at least one projectile in a direction so the projectile enters a body of water adjacent a protected asset in a manner that creates a cavitation region between a shockwave from the explosion and a protected asset such that the shockwave contacts the cavitation region and is attenuated in energy density before it reaches the protected asset.

16. The method of claim 15, wherein detecting includes detecting with a sensor at least two bands of electromagnetic radiation from the explosion.

17. A method of attenuating a shockwave, the method comprising:

detecting with a sensor at least one of an explosive device and an explosion from the explosive device;

calculating with a computer a firing plan based upon at least one of data and models of vulnerability of a protected asset, and at least one of data and models related to a projectile launcher to launch a projectile into a body of water adjacent the protected asset; and if the firing plan determines that it is cost effective to execute the firing plan in view of a cost to operate a projectile launcher and probable cost of damage from a shockwave from the explosion, launching with the projectile launcher at least one projectile in a predetermined direction so the projectile enters the body of water in a manner that creates a cavitation region between a shockwave from the explosion and the protected asset such that the shockwave contacts the cavitation region and is attenuated in energy density before it reaches the protected asset.

18. The method of claim 17, wherein detecting includes measuring a signature of an incoming threat carrying the explosive device;

comparing the signature with known signatures of a plurality of different threats;

determining a probability the incoming threat is one of the plurality of different threats; and calculating includes estimating a probability distribution function of explosion magnitudes and locations relative to the protected asset based on at least one of stored data about a known explosive device, motion of the incoming threat, and the shape, orientation and motion of the protected asset; and making a determination to counter the incoming threat or not to counter the incoming threat, based on one of stored data and models of vulnerability of the protected asset to shockwaves, and data from at least one of data and models related to the projectile launcher with respect to attenuating shockwaves from the estimated explosion magnitudes and locations.

19. The method of claim 17, wherein detecting includes measuring a signature of the explosion from the explosive device;

comparing the signature with known signatures of a plurality of different explosives;

determining a probability the incoming threat is one of the plurality of different explosives; and calculating includes estimating a probability distribution function of explosion magnitudes and locations relative to the protected asset based on at least one of stored data about a known explosive device, motion of the incoming threat, and the shape orientation and motion of the protected asset; and making a determination to counter the incoming threat or not to counter the incoming threat, based on one of stored data and models related to the protected asset to shockwaves, and data from at least one of data and models related to the projectile launcher with respect to attenuating shockwaves from the estimated explosion magnitudes and locations.

20. The method of claim 17, wherein detecting an explosion includes detecting at least two bands of electromagnetic radiation generated by the explosion.

* * * * *